US009307602B2

(12) United States Patent
Yang et al.

(10) Patent No.: US 9,307,602 B2
(45) Date of Patent: Apr. 5, 2016

(54) ILLUMINATION SYSTEM

(71) Applicant: CORETRONIC CORPORATION, Hsin-Chu (TW)

(72) Inventors: Wen-Chih Yang, Hsin-Chu (TW); Yung-Ta Chen, Hsin-Chu (TW); Sheng-Yu Chiu, Hsin-Chu (TW); Fan-Chieh Chang, Hsin-Chu (TW)

(73) Assignee: CORETRONIC CORPORATION, Hsin-Chu (TW)

( * ) Notice: Subject to any disclaimer, the term of this patent is extended or adjusted under 35 U.S.C. 154(b) by 208 days.

(21) Appl. No.: 14/063,109

(22) Filed: Oct. 25, 2013

(65) Prior Publication Data

US 2014/0117857 A1 May 1, 2014

(30) Foreign Application Priority Data

Oct. 31, 2012 (CN) ..... 2012 1 0427957

(51) Int. Cl.
*H05B 33/08* (2006.01)

(52) U.S. Cl.
CPC ..... *H05B 33/0848* (2013.01); *H05B 33/0845* (2013.01)

(58) Field of Classification Search
CPC ..... H05B 33/0848; H05B 33/0845; H05B 33/0854; H05B 33/0857; H05B 33/086; H05B 33/0866; H05B 33/0869; H05B 33/0872
See application file for complete search history.

(56) References Cited

U.S. PATENT DOCUMENTS

| | | | | |
|---|---|---|---|---|
| 6,151,290 | A * | 11/2000 | Morton | G11B 7/127 369/116 |
| 6,734,957 | B2 | 5/2004 | Schmidt et al. | |
| 7,168,826 | B2 | 1/2007 | Imade | |
| 7,217,573 | B1 * | 5/2007 | Oshida | G01N 21/6428 250/347 |
| 7,405,856 | B2 | 7/2008 | Doherty et al. | |
| 8,152,311 | B2 | 4/2012 | Cho | |
| 2005/0135219 | A1 * | 6/2005 | Oka | G11B 7/1362 369/112.05 |
| 2011/0043764 | A1 | 2/2011 | Narikawa | |

FOREIGN PATENT DOCUMENTS

| | | |
|---|---|---|
| CN | 1669367 | 9/2005 |
| CN | 1726415 | 1/2006 |
| CN | 2831294 | 10/2006 |
| CN | 101551977 | 10/2009 |
| DE | 29914555 | 10/1999 |
| JP | 2002214700 | 7/2002 |
| JP | 2006065203 | 3/2006 |
| JP | 2009141107 | 6/2009 |

* cited by examiner

*Primary Examiner* — Jung Kim
(74) *Attorney, Agent, or Firm* — WAPT, PC; Justin King

(57) ABSTRACT

An illumination system for a projection apparatus includes a light source module, an integrating rod and an optical detecting module. The light source module is capable of emitting an illuminating light beam. The integrating rod has a light entrance surface facing toward the light source module. The optical detecting module includes a light guiding device and an optical detecting device. The light guiding device has a first end surface and a second end surface. The first end surface is farther away from the light entrance surface of the integrating rod than the second end surface. The optical detecting device is disposed adjacent to the first end surface of the light guiding device and electrically connected to the light source module. The light source module is capable of adjusting intensity of the illuminating light beam according to randomly emitted light detected by the optical detecting device.

11 Claims, 8 Drawing Sheets

ILLUMINATION SYSTEM

FIELD OF THE INVENTION

The invention relates to an illumination system, and in particularly to an illumination system which is used for projection apparatus and is capable of effectively adjusting light intensity.

BACKGROUND OF THE INVENTION

While performing a white point calibration to a projector, an optical detector is used for detecting light intensities and white balance conditions of red, green and blue light emitting diodes (LEDs) of a light source module of the projector. An application-specific integrated circuit (ASIC) or a digital signal processor (DSP) is used for receiving an electronic signal transformed from an optical signal detected by the optical detector. Thus, corresponding light intensity of the light source module can be measured and used for determining driving current values or duty cycles to apply on the LEDs to optimize the colors of images. Therefore, the choice of the location of the optical detector with respect to the light source module is a critical factor that influences the intensity of the optical signal received by the optical detector and the result of white balance calibration to the projector.

FIG. 1 is a schematic view of a conventional projector 10. FIG. 2 is a schematic view showing an optical detector disposed in the conventional projector 10. An optical detector 11 is directly disposed at a light exit of a light source module 12 and is electrically connected to a circuit board 14. As FIG. 2 shows, the optical detector 11 is disposed above a light entrance surface of an optical integrator 13. Most of light emitted from the light source module 12 is incident into the optical integrator 13 from the light entrance surface, while a part of randomly emitted light from the light source module 12 which does not enter the optical integrator 13 is received by the optical detector 11. After the received optical signals are converted into electronic signals, the electronic signals are transmitted to the signal processor (not shown) through the circuit board 14. Then the signal processor adjusts light intensities and white balance conditions of the light source module 12 according to the electronic signals. However, as the LED packaging technology keeps improving, collimating ability of the light emitted from the light source module 12 is increased. The amount of the randomly emitted light is not enough for the optical detector 11 to receive and corresponding generate electronic signals.

Besides, the optical detector 11 contained inside a sealed housing (not shown) of an optical engine of the projector 10 is close to the high temperature light source module 12. Performance of the optical detector 11 is downgraded as the working temperature of the optical detector 11 is raised. Furthermore, since the optical detector 11 is hung above the light entrance surface of the optical integrator 13 by a supporting member 15, the optical detector 11 may be accidentally tilted from its original position during assembling, causing poor quality of the received optical signal.

Therefore, a problem to be solved is how to properly dispose the optical detector in order to receive signals with better quality and avoiding the influence of the high temperature from the light source module, and correspondingly adjusting the intensity and white balance condition of the light based on the detected results from the optical detector. U.S. Pat. No. 7,168,826 disclosed a projector having a light guiding device, and an optical detector disposed on the light guiding device. U.S. Pat. No. 6,734,957 disclosed an illumination device in a projector, which has an integrating box disposed behind a reflective mirror, and an optoelectronic device disposed inside the integrating box for receiving light. U.S. Pat. No. 7,405,856 disclosed a display system having a light sensor disposed adjacent to an integrating rod. U.S. Pat. No. 8,152,311 disclosed a display apparatus having a light sensor disposed adjacent to a light source. The light sensor can adjust light emitted from the light source according to a detected light intensity.

SUMMARY OF THE INVENTION

The invention provides an illumination system, capable of solving the above mentioned problems that light received by the optical detector is not enough, and the performance of the optical detector is influenced due to be close to the high temperature from the light source module.

For realizing the above advantages, the invention provides an illumination system for a projection apparatus. The illumination system includes a light source module, an integrating rod and an optical detecting module. The light source module is capable of emitting an illuminating light beam. The integrating rod is disposed in a transmission path of the illuminating light beam and has a light entrance surface facing toward the light source module. The optical detecting module includes a light guiding device and an optical detecting device. The light guiding device has a first end surface and a second end surface. The first end surface is farther away from the light entrance surface of the integrating rod than the second end surface. And the optical detecting device is disposed adjacent to the first end surface of the light guiding device and is electrically connected to the light source module. The light guiding device guides a part of randomly emitted light from the illuminating light beam to the optical detecting device. The light source module adjusts intensity of the illuminating light beam according to the randomly emitted light detected by the optical detecting device.

In an embodiment of the invention, the first end surface and the second end surface of the light guiding device are respectively perpendicular to the light entrance surface of the integrating rod.

In an embodiment of the invention, the first end surface of the light guiding device is perpendicular to the light entrance surface of the integrating rod, and the second end surface of the light guiding device is parallel to the light entrance surface of the integrating rod. The light guiding device is L-shaped.

In an embodiment of the invention, the illumination system further includes a lens disposed in the transmission path of the illuminating light beam and located between the light source module and the integrating rod.

In an embodiment of the invention, the illumination system further includes a housing for accommodating the light source module, the lens and the integrating rod.

In an embodiment of the invention, the optical detecting device and the light guiding device are disposed inside the housing.

In an embodiment of the invention, the housing has an opening, and the optical detecting device is located outside the housing, and the second end surface of the light guiding device is inserted into the housing from the opening, and a part of the light guiding device is located in the housing for receiving the randomly emitted light.

In an embodiment of the invention, the optical detecting module further includes a circuit board, and the optical detecting device is disposed on the circuit board and electrically connected to the circuit board, and the optical detecting device is electrically connected to the light source module through the circuit board.

In an embodiment of the invention, the first end surface of the light guiding device further has a recess for accommodating the optical detecting device, and the optical detecting device is sealed by the recess and the circuit board.

In an embodiment of the invention, the second end surface of the light guiding device is a concave surface for colleting the randomly emitted light.

In an embodiment of the invention, after the randomly emitted light enters the second end surface of the light guiding device, the randomly emitted light is transmitted through the light guiding device to the first end surface and is received and detected by the optical detecting device from the first end surface.

In an embodiment of the invention, the light source module includes one light emitting diode or a plurality of light emitting diodes.

The invention uses the light guiding device to guide the randomly emitted light from the light source module to the optical detecting device, the optical detecting device can obtain enough light, and the electronic signal measured and outputted by the optical detecting device satisfies the requirement for the optical detecting device to perform stable detection. Besides, by using the light guiding device to guide light, the optical detecting device can be located farther away from the light source module than the conventional arrangement. The problem that the performance of the optical detecting device is influenced by the high temperature from the light source module is avoided.

BRIEF DESCRIPTION OF THE DRAWINGS

The accompanying drawings are included to provide a further understanding of the embodiments of the invention, and are incorporated in and constitute part of this specification. The drawings illustrate embodiments of the invention and, together with the description, serve to explain the principles of the invention.

DETAILED DESCRIPTION OF PREFERRED EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B " component or one or more additional components are between "A" component and "B" component. Accordingly, the drawings and descriptions will be regarded as illustrative in nature and not as restrictive.

Figure 1:
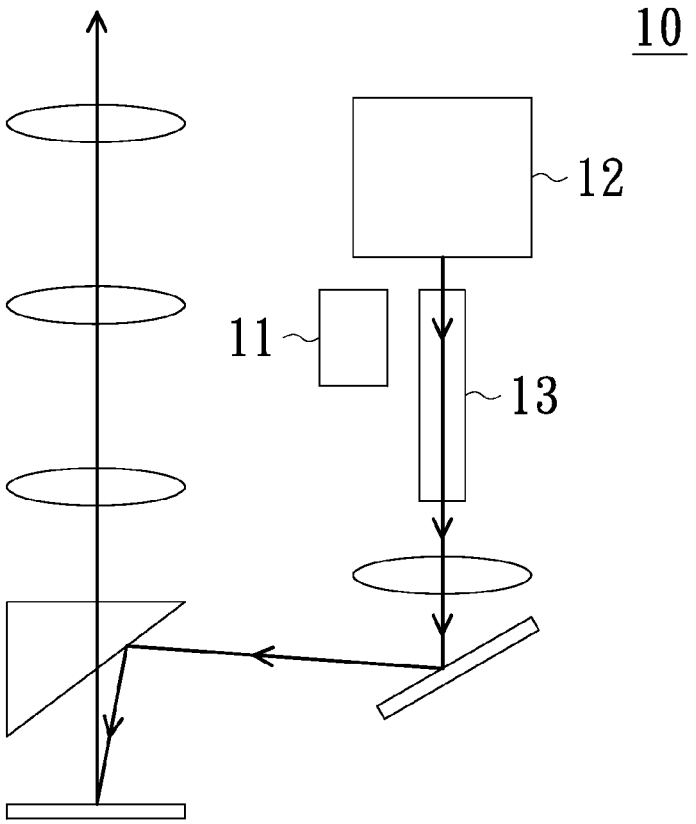
FIG. 1 is a schematic view of a conventional projector.
Figure 2:
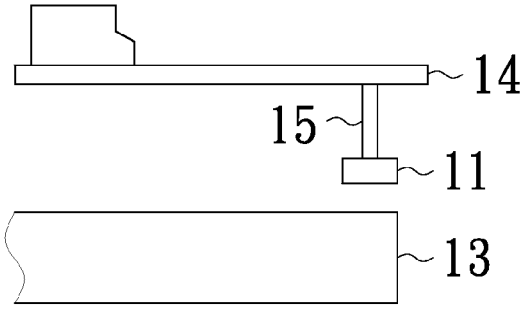
FIG. 2 is a schematic view showing that an optical detector is disposed in the conventional projector.
Figure 3:
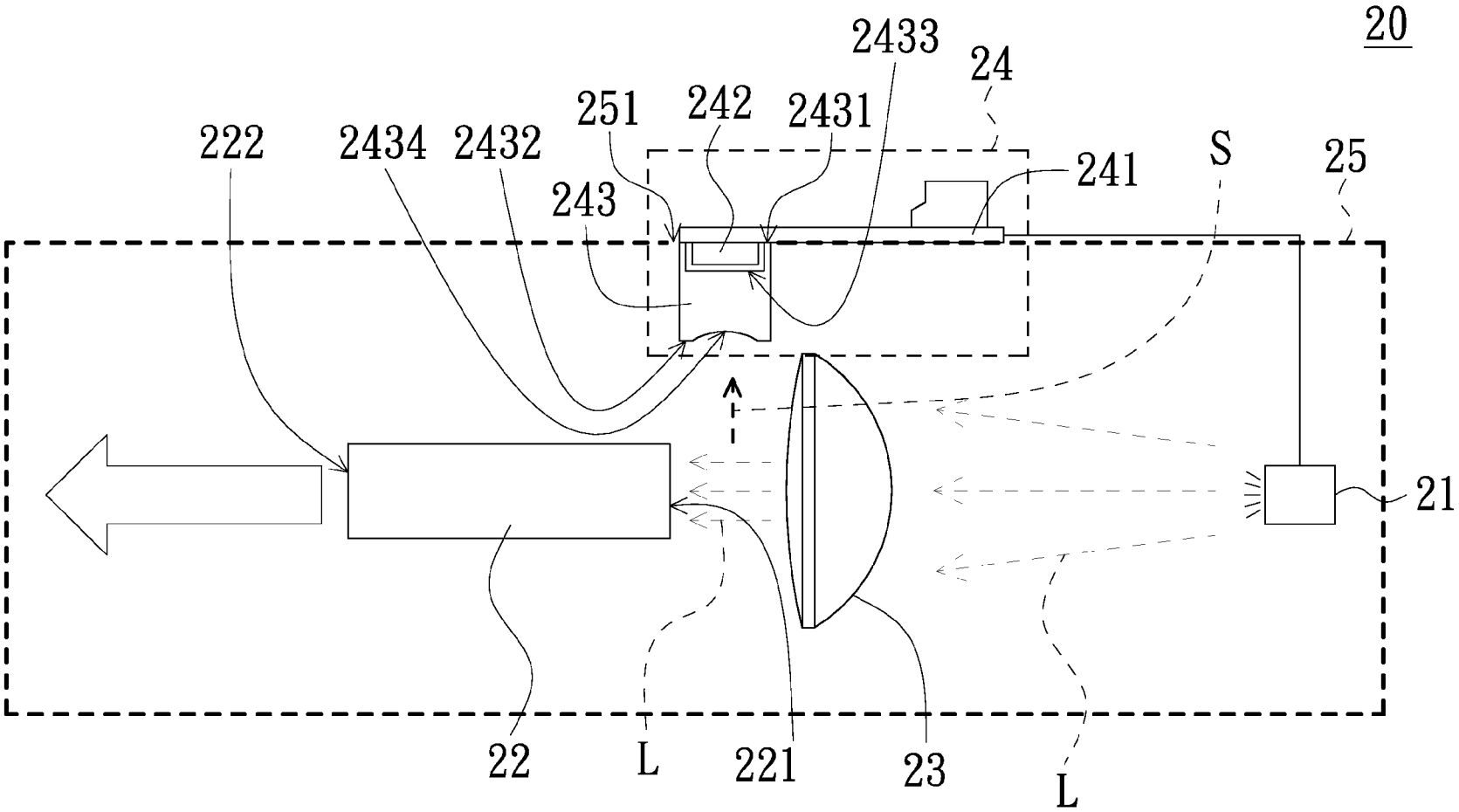
FIG. 3 is a schematic view of an illumination system according to an embodiment of the invention.

FIG. 3 is a schematic view of an illumination system according to an embodiment of the present invention. As FIG. 3 shows, the illumination system 20 used for a projection apparatus includes a light source module 21, an integrating rod 22, a lens 23 and an optical detecting module 24.

The light source module 21 is capable of emitting an illuminating light beam L. The light source module 21 includes, for example, light emitting diodes and a controlling device for providing driving current to the light emitting diodes. In practical, the invention is not limited to the light emitting diodes and may include other types of light sources. Besides, the light source module 21 may include a single light emitting device providing a monochromatic light, such as a single lamp, a high power single light emitting diode, or a light emitting combination provided mixing multiple colors of lights. The light emitting combination consists of, for example, a plurality of light emitting devices having different colors of lights and optical elements such as lenses.

The integrating rod 22 may be a hollow integrating rod or a solid integrating rod. The integrating rod 22 is disposed in a transmission path of the illuminating light beam L, and is used for homogenizing the light intensity of the illuminating light beam L emitted from the light source module 21. In this embodiment, the integrating rod 22 is, for example, a cuboid rod, but not limited thereto. The lens 23 is disposed in the transmission path of the illuminating light beam L and located between the light source module 21 and the integrating rod 22, and used for converging the illuminating light beam L emitted from the light source module 21 to a light entrance surface 221 of the integrating rod 22. More specifically, the lens 23 is, for example, a convex lens. The illuminating light beam L emitted from the light source module 21 is converged by the lens 23 and homogenized by the integrating rod 22, and then emitted out from a light exit surface 222 of the integrating rod 22. After that, the intensity distribution on a cross section of the illuminating light beam L emitted from the light exit surface 222 is uniformized.

The light detecting module 24 includes a circuit board 241, an optical detecting device 242 and a light guiding device 243. The light guiding device 243 is, for example, a transparent rod, or a rod coated or attached with reflective layer on an outer surface, but not limited thereto in practical use. The light guiding device 243 has a first end surface 2431 and a second end surface 2432. The first end surface 2431 is farther away from the light entrance surface 221 of the integrating rod 22 than the second end surface 2432. In this embodiment, the second end surface 2432 is adjacent to the light entrance surface 221 of the integrating rod 22. The first end surface 2431 and the second end surface 2432 are substantially perpendicular to the light entrance surface 221 of the integrating rod 22. In other words, the light guiding device 243 is, for example, a straight rod disposed perpendicular to the integrating rod 22, and the first end surface 2431 and the second end surface 2432 are opposite to each other. The optical detecting device 242 is disposed adjacent to the first end surface 2431 of the light guiding device 243 and the optical detecting device 242 is electrically connected to the light source module 21. A part of the randomly emitted light S from the illuminating light beam L is guided by the light guiding device 243 to the optical detecting device 242. In the embodiment, the randomly emitted light S is scattering light from the lens 23 or the entrance surface 221 of the integrating rod 22. The light source module 21 may adjust intensity of the illuminating light beam L according to the randomly emitted light S detected by the optical detecting device 242. More specifically, in this embodiment, after the randomly emitted light S enters the second end surface 2432 of the light guiding device 243, the randomly emitted light S is transmitted and homogenized through the light guiding device 243 to the first end surface 2431, and then received by the optical detecting device 242 from the first end surface 2431. The randomly emitted light S received by the optical detecting device 242 can be converted into electronic signals. The controlling device of the light source module 21 for providing driving current to the light emitting diodes of the light source module 21 adjusts the outputted current intensity according to the electronic signal outputted from the optical detecting device 242, and the illuminating light beam L emitted from the light emitting diodes can be correspondingly adjusted to have appropriate light intensity and white balance condition.

In a more detailed description, the optical detecting device 242 of the embodiment is disposed on the circuit board 241 and is electrically connected to the circuit board 241. The optical detecting device 242 is electrically connected to the light source module 21 through the circuit board 241.

More specifically, the illumination system 20 of the embodiment further includes a housing 25 for accommodating the light source module 21, the integrating rod 22 and the lens 23. In this embodiment, the housing 25 is, for example, a housing of an optical engine of the projection apparatus. The housing 25 has an opening 251. In this embodiment, the circuit board 241 is located outside the housing 25, and the optical detecting device 242 and the light guiding device 243 of the optical detecting module 24 are inserted into the housing 25 through the opening 251.

From the above description, the illumination system 20 uses the light guiding device 243 to guide the randomly emitted light S emitted from the lens 23 or the entrance surface 221 of the integrating rod 22 to the optical detecting device 242, the intensity of the randomly emitted light S received by the optical detecting device 242 can be increased. After the optical detecting device 242 converts the detected optical signals into electronic signals according to the received randomly emitted light S, the correspondingly outputted voltage may higher than the standard voltage that the optical detecting device 242 can stably perform detection. Besides, since the illumination system 20 uses the light guiding device 243 to guide the randomly emitted light S to the optical detecting device 242, the optical detecting device 242 can be located farther away from the light source module 21 than the conventional arrangement, thus the thermal influence from the high temperature from the light source module 21 can be avoided, and the performance of the optical detecting device 242 will not be affected and the detection can be accurately implemented.

Besides, a recess 2433 can be formed on the first end surface 2431 of the light guiding device 243 for accommodating the optical detecting device 242. The optical detecting device 242 is hermetically sealed by the recess 2433 and the circuit board 241 for protecting the optical detecting device 242 and providing dustproof function. In another aspect, the second end surface 2432 of the light guiding device 243 is, for example, a concave surface 2434 for enhancing the light collecting ability to the randomly emitted light S and increasing the light intensity of the randomly emitted light S received.

When the optical detecting device 24 needs to be repaired, the light guiding device 243 can be directly pulled out from the housing through the opening 251 without opening the housing 25. Thus, dust can be prevented from entering the inner side of the housing 25. In addition, the light source module 21 can be also pulled out from the housing 25 to be repaired when the light guiding device 243 seals the opening 251 of the housing 25.

Figure 4:
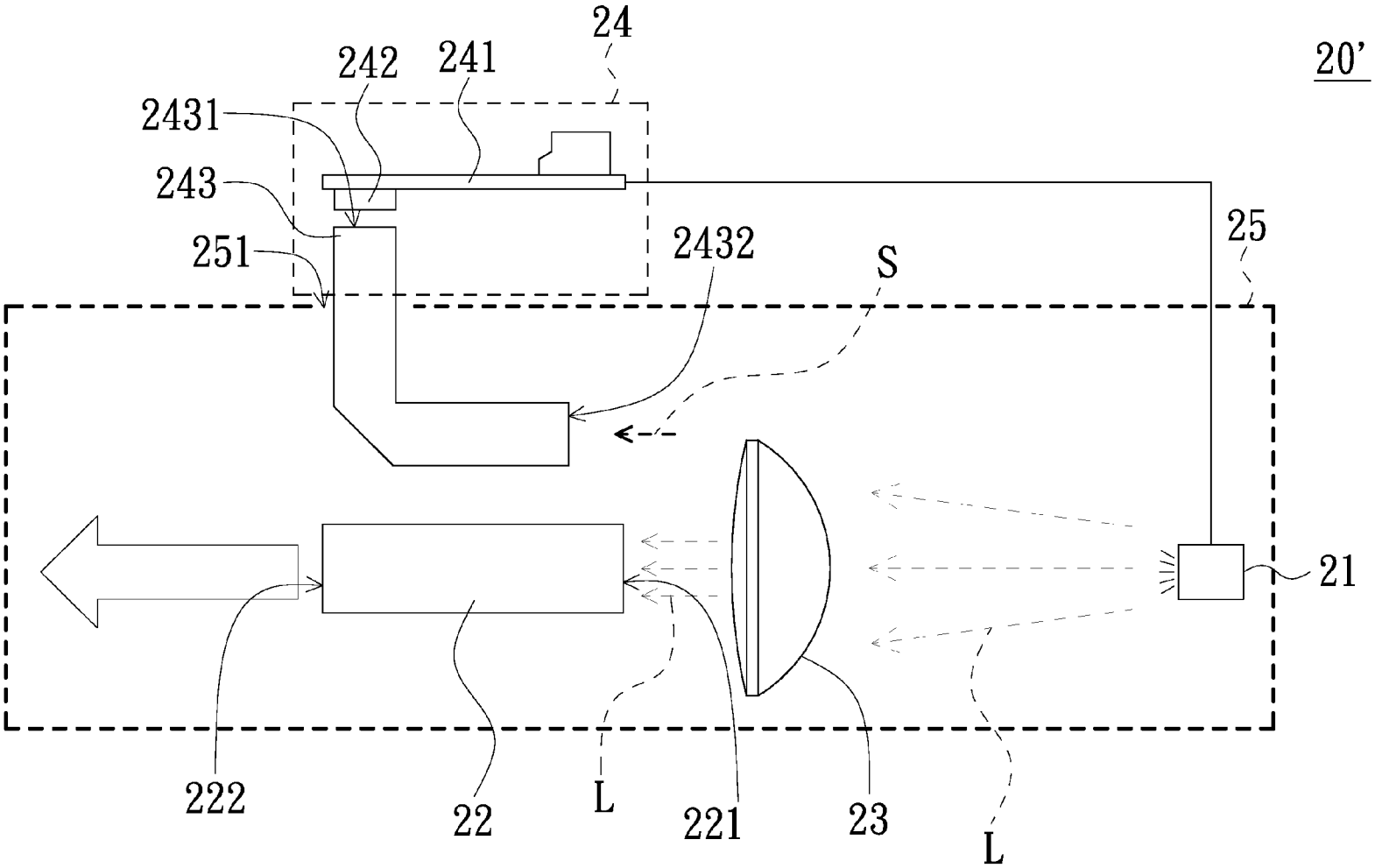
FIG. 4 is a schematic view of an illumination system according to another embodiment of the invention.

FIG. 4 is a schematic view of an illumination system according to another embodiment of the invention. The illumination system 20' is substantially the same as the illumination system 20 in FIG. 3. The difference is that the opening 251 of the housing 25 is moved to a position farther away from the light source module 21, and the optical detecting device 242 and the first end surface 2431 of the light guiding device 243 of the light detecting module 24 are located outside the housing 25. More specifically, the first end surface 2431 of the light guiding device 243 is substantially perpendicular to the light entrance surface 221 of the integrating rod 22. The second end surface 2432 of the light guiding device 243 is adjacent to the light entrance surface 221 of the integrating rod 22 and is substantially parallel to the light entrance surface 221. In other words, the light guiding device 243 is substantially L-shaped. The second end surface 2432 is inserted into the housing 25 from the opening 251 and a part of the light guiding device 243 is located inside the housing 25. The first end surface 2431, the optical detecting device 242 and the circuit board 241 are located outside the housing 25. Therefore, since the optical detecting device 242 is farther away from the light source module 21, the thermal influence from the high temperature from the light source module 21 can be avoided, and the manufacturing and designing of the illumination system can have more flexibility.

Figure 5A:
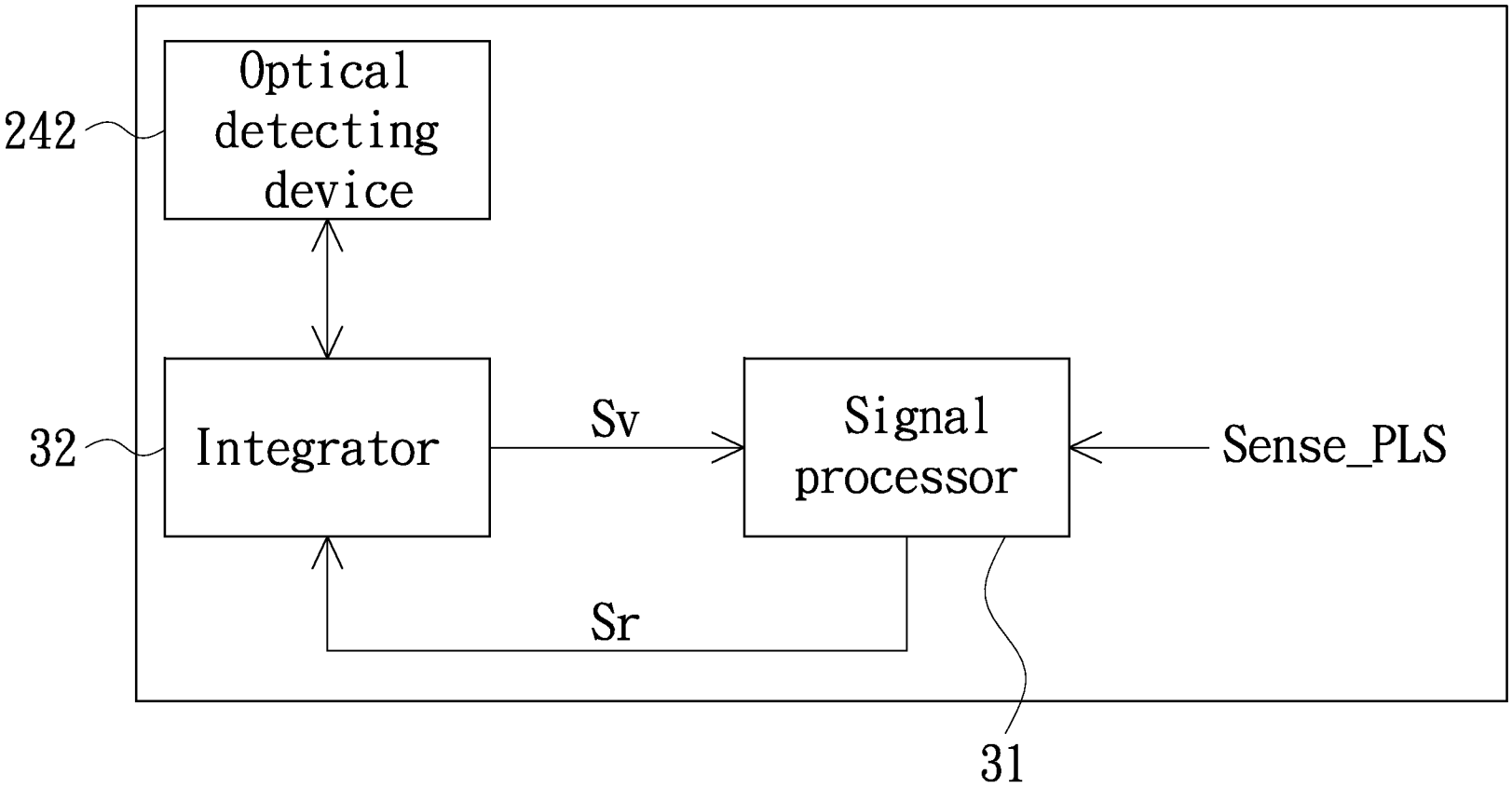
FIG. 5A is a schematic circuit block diagram of the illumination system according to an embodiment of the invention.
Figure 5B:
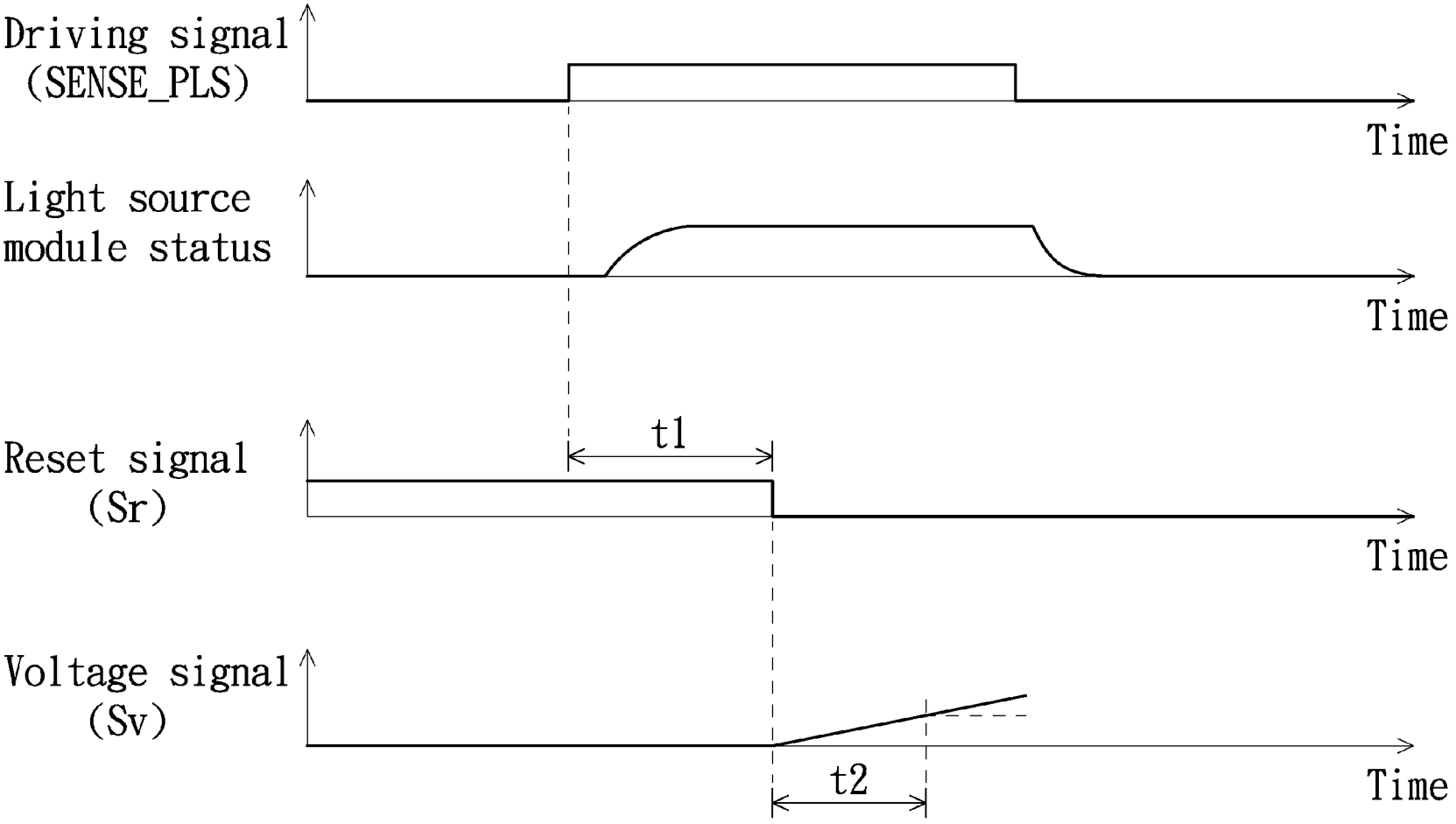
FIG. 5B is a graph comparing signals in FIG. 5A.

FIG. 5A is a schematic circuit block diagram of the illumination system according to an embodiment of the invention. FIG. 5B is a graph comparing signals in FIG. 5A. Referring to FIG. 3, FIG. 4, FIG. 5A and FIG. 5B, in practical operation, when a driving signal (SENSE_PLS) received by a signal processor 31 is high, the light source module 21 will be correspondingly activated. After a period of start-up time t1, the signal processor 31 will transmit a reset signal Sr to an integrator 32, and the optical detecting device 242 electrically connected to integrator 32 is correspondingly activated.

Meanwhile, the randomly emitted light S received by the optical detecting device 242 is converted into electrical current for charging the integrator 32. The electrical potential difference obtained is represented as a voltage signal Sv to be outputted to the signal processor 31. After a period of receiving time t2, the optical detecting device 242 can be turned off when the voltage signal Sv received by the signal processor 31 reaches a predetermined value. In this embodiment, since the light guiding device 243 effectively increases the amount of light received by the optical detecting device 242, the period of receiving time t2 in FIG. 5B can be shortened.

Figure 6A:
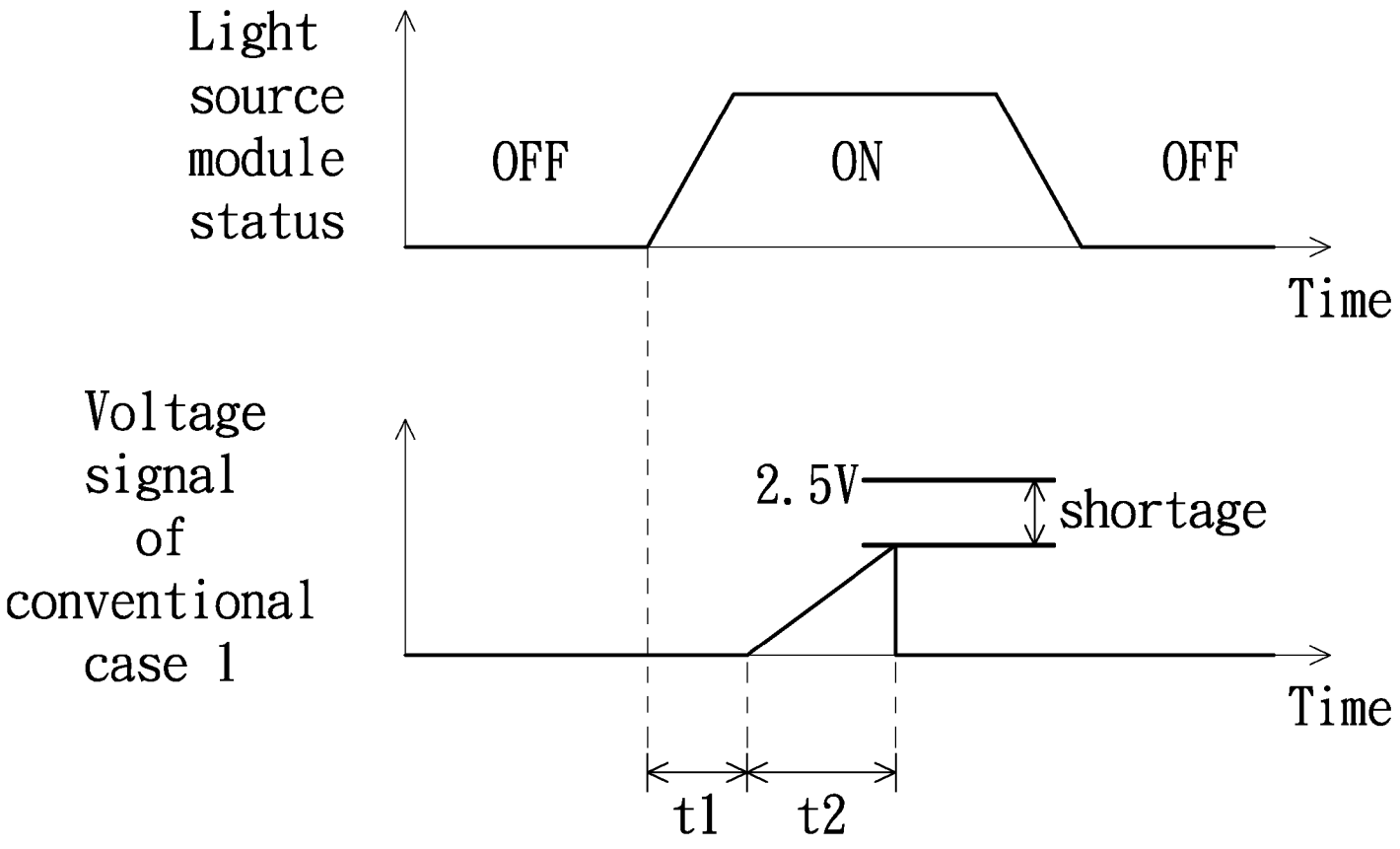
FIG. 6A and FIG. 6B are graphs comparing voltage signals of the conventional cases with that of the embodiment of the invention.
Figure 6B:
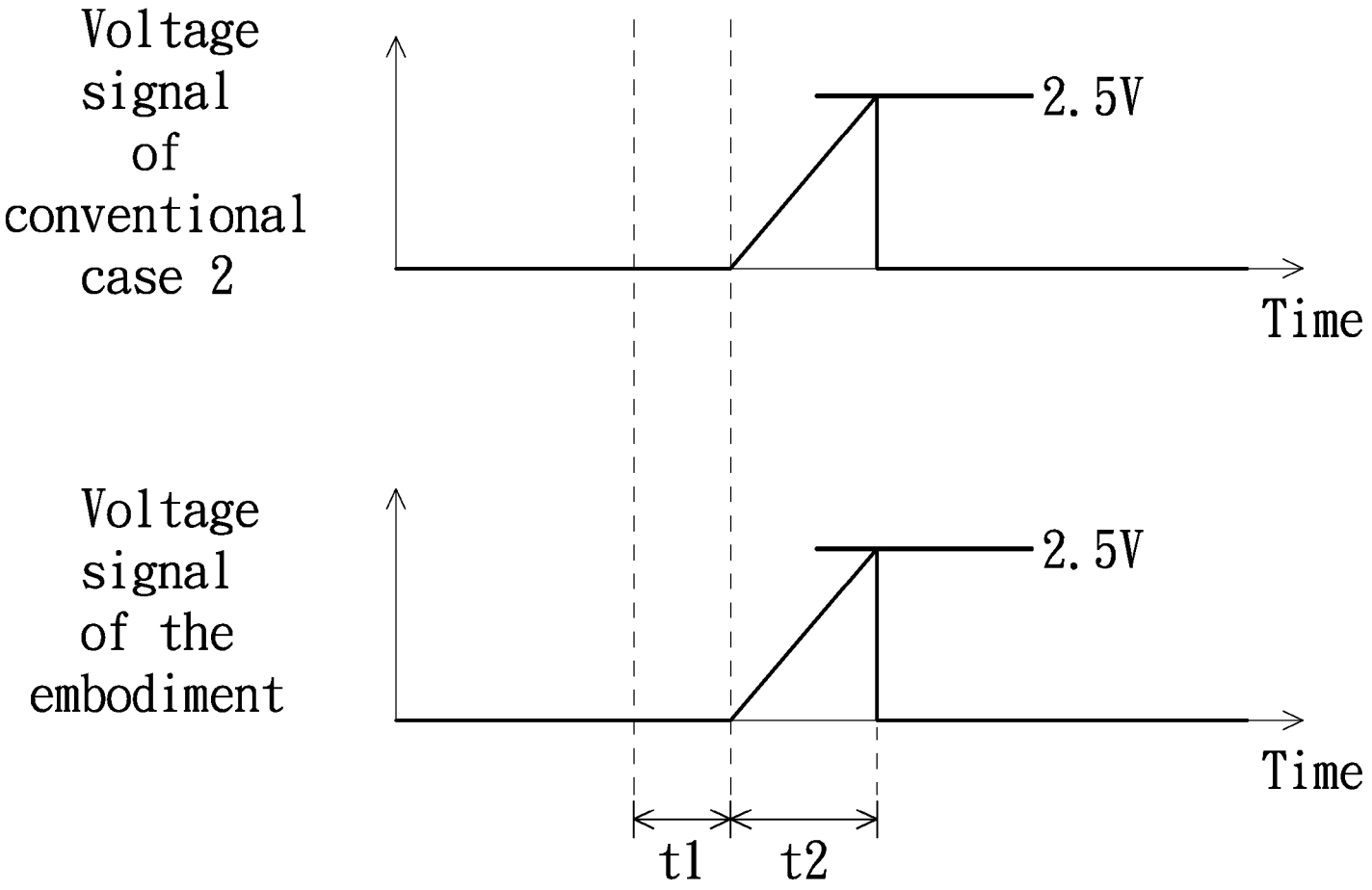

FIG. 6A and FIG. 6B are graphs comparing voltage signals of the conventional cases with a voltage signal of the embodiment of the invention. As shown in FIG. 6A and FIG. 6B, after the light source module is turned on for the period of start-up time t1, the optical detecting device will be started to be activated and convert the detected optical signals into electronic signals according to the received randomly emitted light S. In conventional case 1 shown in FIG. 6A, the optical detecting module does not have a light guiding device and the position of optical detecting device is far away from the light source module, thus not enough light can be received by the optical detecting device. After the period of receiving time t2, the obtained voltage signal is lower than the predetermined value, which is 2.5V, and not enough for the optical detecting device to perform stable detection. However, the working temperature of the optical detecting device is below 60 degree Celsius, which satisfies the requirement. In conventional case 2 shown in FIG. 6B, the optical detecting module does not have a light guiding device and the optical detecting device is close to the light source module, thus enough light can be received by the optical detecting device. After the period of receiving time t2, the obtained voltage signal is higher than or equal to 2.5V and enough for the optical detecting device to perform stable detection. However, the working temperature of the optical detecting device is above 60 degree Celsius duo to high temperature from the light source module, which does not satisfy the requirement. In the embodiment of the invention, as FIG. 3, FIG. 4 and FIG. 6B show, by using the above mentioned light guiding device, even the location of the optical detecting device is far away from the light source module, enough light can be received by the optical detecting device. After the period of receiving time t2, the obtained voltage signal is higher than or equal to 2.5V and enough for the optical detecting device to perform stable detection. And the working temperature of the optical detecting device is below 60 degree Celsius, which also satisfies the requirement.

Figure 7:
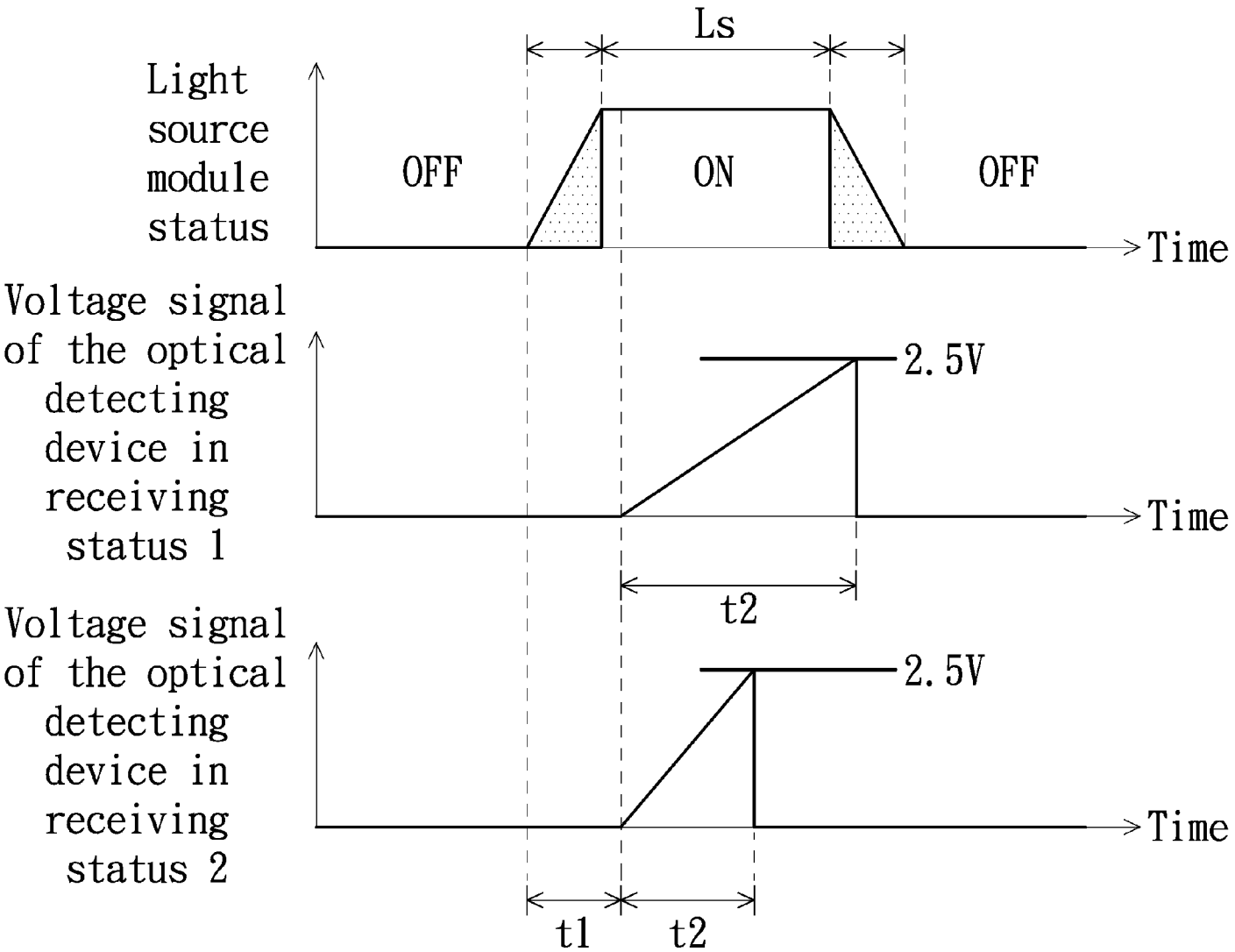
FIG. 7 is a graph comparing signals of different receiving statuses of the optical detecting device according to an embodiment of the invention.

FIG. 7 is a graph comparing signals of different receiving statuses of the optical detecting device according to an embodiment of the invention. Beside of using the light guiding device that the optical detecting device can be far away from the light source module, the invention alternatively uses hardware or software design to extend the period of receiving time t2 for obtaining a voltage signal outputted from the optical detecting device which can satisfy the requirement. It should be noted that since the intensity of the illuminating light beam emitted from the light source module is not stable during the period of start-up time t1 as shown in FIG. 7. The period of receiving time t2 of the optical detecting device should be arranged within a stabilized period Ls that is followed after the period of start-up time t1 of the light source module. And the period of receiving time t2 should be shorter than the stabilized period Ls. During the stabilized period Ls, the optical detecting device can stably receive the randomly emitted light which is a part of the illumination light beam emitted from the light source module, and convert it into electronic signals to output. Otherwise the obtained electronic signals will be unstable. FIG. 7 depicts different receiving statuses of an optical detecting device located at the same position. The optical detecting device in receiving status 1 does not use a light guiding device, but uses hardware or software design to extend the period of receiving time t2 of the optical detecting device. In the receiving status 1, the period of receiving time t2 is followed after the period of start-up time t1, but exceeds the stabilized period Ls, resulting in that the outputted voltage signal is unstable. The optical detecting device in receiving status 2 uses a light guiding device for collectively receiving randomly emitted light. In the receiving status 2, the period of receiving time t2 is followed after the period of start-up time t1 and does not exceed the stabilized period Ls, resulting in that the outputted voltage signal is stable.

In conclusion, the invention uses the light guiding device to guide the randomly emitted light from the light source module to the optical detecting device, the optical detecting device can receive enough light, and the electronic signal measured by the optical detecting device satisfies the requirement for the optical detecting device to perform stable detection.

Besides, by using the light guiding device to guide light, the optical detecting device can be located farther away from the light source module than the convention arrangement. The problem that the performance of the optical detecting device is influenced by the high temperature from the light source module is avoided.

Moreover, when the optical detecting module needs to be repaired, the housing of the optical engine does not have to be opened, thus dust can be prevented from entering the inner side of the housing.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An illumination system for a projection apparatus, the illumination system comprising:

a light source module capable of emitting an illuminating light beam;

an integrating rod disposed in a transmission path of the illuminating light beam and having a light entrance surface facing toward the light source module; and an optical detecting module comprising a light guiding device and an optical detecting device, the light guiding device having a first end surface and a second end surface, the first end surface being farther away from the light entrance surface of the integrating rod than the second end surface, and the optical detecting device being disposed adjacent to the first end surface of the light guiding device and electrically connected to the light source module, wherein the light guiding device guides a part of randomly emitted light from the illuminating light beam to the optical detecting device, and the light source module adjusts intensity of the illuminating light beam according to the randomly emitted light detected by the optical detecting device, wherein the light guiding device is a rod, and after the randomly emitted light enters the second end surface of the light guiding device, the randomly emitted light is transmitted and homogenized through the light guiding device to the first end surface, and is received and detected by the optical detecting device.

2. The illumination system according to claim 1, wherein the first end surface and the second end surface of the light guiding device are respectively perpendicular to the light entrance surface of the integrating rod.

3. The illumination system according to claim 1, wherein the first end surface of the light guiding device is perpendicular to the light entrance surface of the integrating rod, and the second end surface is parallel to the light entrance surface of the integrating rod, and the light guiding device is L-shaped.

4. The illumination system according to claim 1, further comprising a lens disposed in the transmission path of the illuminating light beam and located between the light source module and the integrating rod.

5. The illumination system according to claim 4, further comprising a housing for accommodating the light source module, the lens and the integrating rod.

6. The illumination system according to claim 5, wherein the optical detecting device and the light guiding device are disposed inside the housing.

7. The illumination system according to claim 5, wherein the housing has an opening, and the optical detecting device is located outside the housing, and the second end surface of the light guiding device is inserted into the housing from the opening, and a part of the light guiding device is located in the housing for receiving the randomly emitted light.

8. The illumination system according to claim 1, wherein the optical detecting module further comprises a circuit board, and the optical detecting device is disposed on the circuit board and electrically connected to the circuit board, and the optical detecting device is electrically connected to the light source module through the circuit board.

9. The illumination system according to claim 8, wherein the first end surface of the light guiding device further has a recess for accommodating the optical detecting device, and the optical detecting device is sealed by the recess and the circuit board.

10. The illumination system according to claim 1, wherein the second end surface of the light guiding device is a concave surface for colleting the randomly emitted light.

11. The illumination system according to claim 1, wherein the light source module comprises one light emitting diode or a plurality of light emitting diodes.

* * * * *